US012616888B1

(12) United States Patent
Hammond

(10) Patent No.: US 12,616,888 B1
(45) **Date of Patent: *May 5, 2026**

(54) DISC GOLF DISC RETRIEVAL DEVICE

(71) Applicant: Shawn Hammond, McKinney, TX (US)

(72) Inventor: Shawn Hammond, McKinney, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/237,472

(22) Filed: Jun. 13, 2025

Related U.S. Application Data

(63) Continuation-in-part of application No. 18/984,617, filed on Dec. 17, 2024, which is a continuation-in-part of application No. 17/575,473, filed on Jan. 13, 2022, now Pat. No. 12,330,025.

(51) Int. Cl.
*A63B 65/10* (2006.01)

(52) U.S. Cl.
CPC ..... *A63B 65/10* (2013.01)

(58) Field of Classification Search
CPC ..... A63B 2209/08; A63B 67/06; A63B 47/02; A63B 65/10
See application file for complete search history.

(56) References Cited

U.S. PATENT DOCUMENTS

| | | | | |
|---|---|---|---|---|
| 52,748 | A | 2/1866 | Roche | |
| 1,769,196 | A | 7/1930 | Walsh | |
| 4,021,068 | A * | 5/1977 | Piazza | A63B 47/02 294/19.2 |
| 4,926,522 | A | 5/1990 | Wang | |
| 5,199,716 | A | 4/1993 | DeFluiter | |
| 6,213,672 | B1 | 4/2001 | Varga | |
| 6,453,777 | B1 | 9/2002 | Newman et al. | |
| 7,066,511 | B2 | 6/2006 | Newman | |
| 7,934,756 | B2 * | 5/2011 | Kroeze | B25J 1/04 294/115 |
| 8,657,351 | B2 | 2/2014 | Johnson | |
| 8,967,072 | B2 | 3/2015 | Chen | |

(Continued)

FOREIGN PATENT DOCUMENTS

| | | |
|---|---|---|
| CN | 210732442 U | 6/2020 |
| DE | 9215917 U1 | 5/1993 |

OTHER PUBLICATIONS

Amazon.com, Bird Dog Disc Golf Retriever Pole , Jul. 27, 2021, https://www.amazon.com/Bird-Disc-Golf-Retriever-Pole/dp/B09BBXLSMT?ref_=ast_sto_dp (Year: 2021); 4 pp.

(Continued)

*Primary Examiner* — Stephen A Vu

(57) ABSTRACT

A disc golf disc retrieval device that is simple to operate and allows a disc golf disc player or user to conveniently, quickly, and efficiently to engage with and retrieve a disc golf disc in hard to reach or unreachable places that can reduce downtime during a disc golf game, among other uses and advantages. Here, the disc golf disc retrieval device can include a retrieval head, a plurality of flexible post members extending from the retrieval head, wherein each of the flexible post member comprise a suction cup, and wherein the suction cup is configured to enable engagement of a disc golf disc thereto. The device can further include a telescoping pole member and a securement member configured to secure the retrieval head to the telescoping pole member.

8 Claims, 5 Drawing Sheets

(56) References Cited

U.S. PATENT DOCUMENTS

| | | | | |
|---|---|---|---|---|
| 9,265,997 | B1 * | 2/2016 | Good, Jr. | A63B 57/00 |
| 9,945,513 | B2 * | 4/2018 | Whitney | A47K 1/09 |
| 12,330,025 | B1 * | 6/2025 | Hammond | A63B 65/10 |
| 2006/0055189 | A1 * | 3/2006 | Dalsing | A63B 57/00 294/19.2 |
| 2008/0302215 | A1 | 12/2008 | Johnson | |
| 2010/0024606 | A1 | 2/2010 | Becker | |
| 2011/0221219 | A1 * | 9/2011 | Heaton | A63B 47/02 294/210 |
| 2017/0087421 | A1 | 3/2017 | Chabot | |
| 2018/0345087 | A1 | 12/2018 | Batista | |

OTHER PUBLICATIONS

DG Puttheads, Best Disc Golf Disc Retriever, Disc Golf Puttheads; Oct. 26, 2020, Retrieved on Aug. 26, 2025 from: https://www.dgputtheads.com/best-disc-golf-disc-retriever; 17 pp.

Prodigy Disc Retreiver, Prodigy Disc, Mar. 19, 2021, retrieved on Feb. 22, 2026 from: https://www.youtube.com/watch?v=5iZfBY-iFgl; 1 p.

In-Zone Kwik-Stik XL Review Update, In the Circle Disc Golf, Jun. 27, 2021, retrieved on Feb. 22, 2026 from: https://www.youtube.com/watch?v=_KA2cPX_oHM; 1 p.

Dynamic Discs Retriever Product Review, Disc Golf Examiner, Jun. 21, 2021, retrieved on Feb. 22, 2026 from: https://www.youtube.com/watch?v=Pfi5AWOU47g; 1 p.

Infinite Discs Rescue Retriever, Infinite Discs, Wayback Machine, Jan. 18, 2021, retrieved on Feb. 22, 2026 from: https://web.archive.org/web/20210118063745/ https:/infinitediscs.com/Products/Retrievers/18209/Infinite-Discs-Rescue-Retriever; 5 pp.

Retriever, Infinite Discs, Wayback Machine, Aug. 13, 2021, retrieved on Feb. 22, 2026 from: https://web.archive.org/web/20210813033958/ https:/infinitediscs.com/Products/Retrievers; 5 pp.

Appendix A, third party claim chart with respect to U.S. Pat. No. 12,330,025, Sep. 23, 2025; 18 pp.

* cited by examiner

DISC GOLF DISC RETRIEVAL DEVICE

CROSS REFERENCE TO RELATED APPLICATIONS

This application is a continuation-in-part (CIP) of U.S. Non-Provisional application Ser. No. 18/984,617 filed on Dec. 17, 2024, which is incorporated herein by reference in its entirety, which is a CIP of U.S. Non-Provisional application Ser. No. 17/575,473 filed on Jan. 13, 2022, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Disc golf has been growing in popularity within the past few years. Disc golf is a flying disc sport which involves players throwing discs into a series of disc golf baskets on a course. The goal of disc golf is to throw the disc toward each disc golf basket in the lowest number of throws. The player who has the lowest number of throws at the end of each course is the winner.

While playing disc golf is enjoyable, the retrieval of disc golf discs can be painstakingly frustrating. For example, after a disc golf disc is thrown, the disc golf disc can land in various unreachable areas such as in bodies of water, rough vegetation, trees, or other terrain that requires significant retrieval effort from the player. Thus, retrieval of these disc golf discs can be inconvenient, laborious, time consuming, and result in downtime during a game.

Hence, what is needed is a device that enables a player to quickly and efficiently retrieve a disc golf disc in hard to reach or unreachable places.

BRIEF SUMMARY

In one non-limiting exemplary embodiment of the disclosure described herein, a disc golf disc retrieval device that is simple to operate and allows a disc golf disc player or user to conveniently, quickly, and efficiently to engage with and retrieve a disc golf disc in hard to reach or unreachable places that can reduce downtime during a disc golf game, among other uses and advantages. Here, the disc golf disc retrieval device can include a retrieval head, a plurality of flexible post members extending from the retrieval head, wherein each of the flexible post member comprise a suction cup, and wherein the suction cup is configured to enable engagement of a disc golf disc thereto. The device can further include a telescoping pole member and a securement member configured to secure the retrieval head to the telescoping pole member. In addition, the securement member may include a threaded member. Further, the retrieval head may also include a bore, channel, or opening extending therethrough. Also, the securement member may include a male threaded member and a female threaded member. In addition, the male threaded member may be disposed within the bore, channel, or opening of the retrieval head. Moreover, the female threaded member may be secured to a distal end of the telescoping pole member. Further, the male threaded member may be adapted to engage the female threaded member.

In another non-limiting exemplary embodiment of the disclosure described herein, a disc golf disc retrieval system can include a retrieval head, a post member extending from the retrieval head, and a suction cup secured to the post members. In addition, the disc golf disc retrieval system can include a telescoping pole member, a securement member configured to secure the retrieval head to the telescoping pole member, and a disc golf disc retrieval accessory secured to the securement member. Further, the retrieval accessory may include a hook member.

In another non-limiting exemplary embodiment of the disclosure described herein, a disc golf disc retrieval system can include a head member, a protruding member extending from the head member, and a suction member secured to the protruding member. In addition, a telescoping pole member can include a proximal end and a distal end. Further, a securement member may be configured to secure the head member to the distal end of the telescoping pole member, and to further secure an accessory to the head member.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
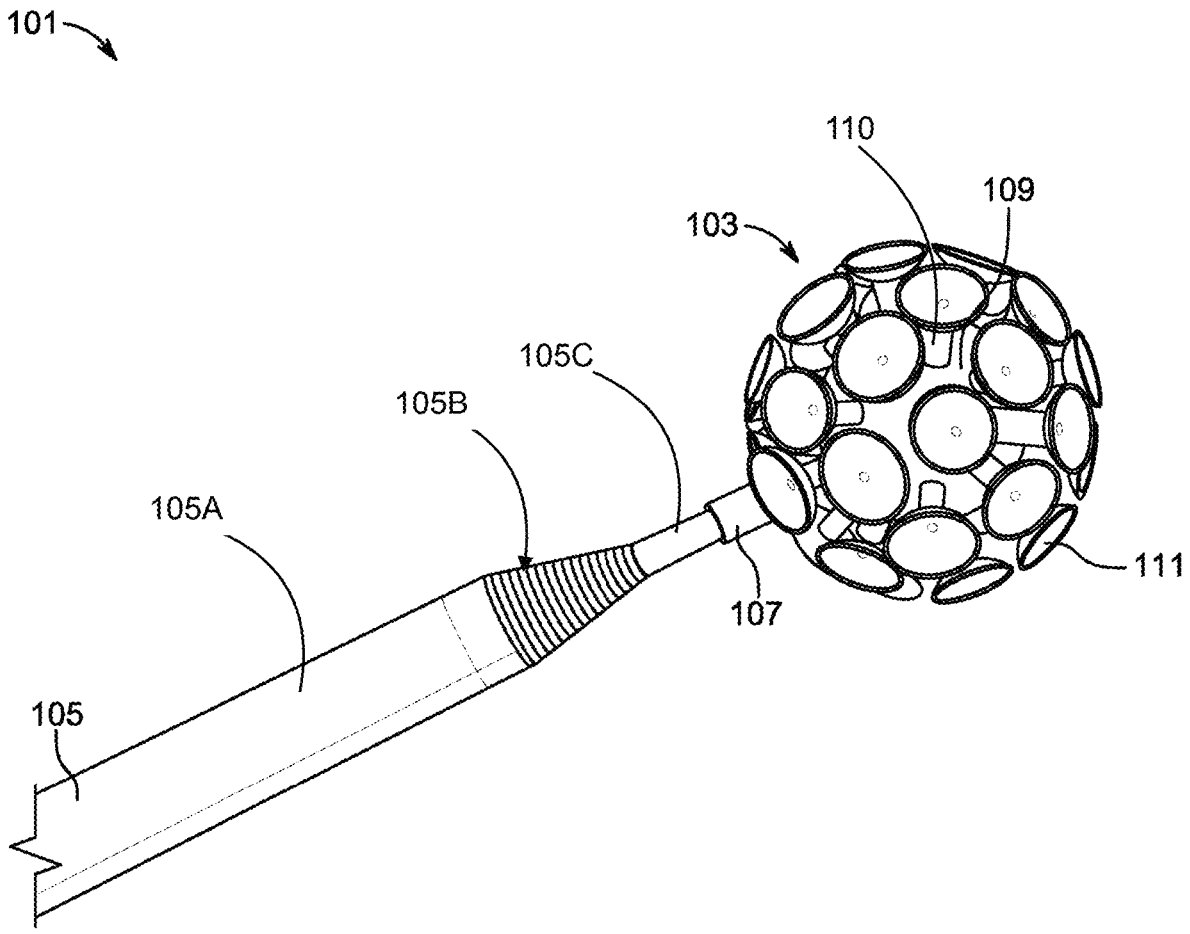
FIG. 1 illustrates a perspective view of a disc golf disc retrieval device, according to one non-limiting exemplary embodiment of the disclosure described herein.

FIG. 1 illustrates one non-limiting exemplary embodiment of the disc golf disc retrieval device 101 of the disclosure described herein. Here, the disc golf disc retrieval device 101 can include a retrieval head 103 removably connected to a telescoping pole member 105 via a connection mechanism or securement member 107. The retrieval head 103 is generally configured in a substantially spherical configuration, however, it is contemplated within the scope of the present disclosure described herein that head 103 may also be in various other configurations, such as substantially square, rectangular, ellipsoid, oval, triangular, polygonal, or asymmetric, among others. Further, the retrieval head 103 includes a spherical member 109 having a plurality of suction cups or suction members 111 extending therefrom. Here, retrieval head 103 may include any number of suction cups 111, such as from one suction cup up to and including 200 suction cups. Here, each suction cup 111 is secured to one end of flexible cylindrical post member 110, wherein an opposing end of the post member 110 secured to the body of spherical member 109. Here, each post member 110 and suction cup 111 may be elastic, flexible, semi-rigid, or rigid in nature and may be secured to each other via any type of adhesive or fastening member, or via fusing/soldering, via mechanical connectors, via magnets, or constructed as one unitary piece. In addition, each post member 110 may further be secured to spherical member 109 via any type of adhesive or fastening member, or via fusing/soldering, via mechanical connectors, via magnets, or constructed as one unitary piece with member 109. Here, it is contemplated within the scope of the present disclosure described herein that any of members of 109, 110, and 111 may be made of any type of material, including but not limited to rubber, silicone, plastics, polymers, neoprene (Chloroprene), nitrile, Ethylene Propylene Diene Monomer (EPDM), natural rubber, synthetic rubber, Viton (Fluorocarbon Rubber), Styrene Butadiene Rubber (SBR), butyl rubber, and polyurethane (PU), metals, wood, leather, textiles, fiberglass, or composites, among others.

Further, the plurality of suction cups 111 are configured to enable engagement of a disc golf disc thereto (not shown). In some embodiments, the plurality of suction cups 111 may include brightly colored materials, colored patterns, images, or the like to provide improved visibility of the retrieval head in poor visibility conditions. As an example, the suction cups may be yellow, red, orange, purple, blue, black, white, or the like, or any combination of colors. As a further example, some suction cups 111 may be black while others may be red, or some in blue and others in yellow, in order to create various patterns or themes and/or further improve their visibility. In addition, it is contemplated within the scope of the present disclosure described herein that members 109, 110, and 11 (either some or all) may also include any glow-in-the dark properties or materials, such as phosphors zinc sulfide and/or strontium aluminate, to help further improve visibility in dark conditions.

In other embodiments, while not shown, spherical member 109 may include one or more air pump(s) in fluid communication with each suction cup 111 that allows the air pump(s) to create an additional air suction or vacuum force in order to engage an object or a disc golf disc. In such an embodiment, the air pump may be engaged via switch member on the telescoping member, wherein the air pumps can further be powered by a power source (such as a battery) disposed within the telescoping member or the spherical member 109.

Still referring to FIG. 1, the telescoping pole member 105 can include a handle or grip region 105A in a substantially cylindrical configuration. Further, disposed within the handle region 105A include a plurality of elongated cylindrical members 105B nestled within or over each other, wherein each of members 105B include varying diameters (large to small or vice versa) that allow retrieval head 103 secured to pole member 105 to extend to a range from 1 in. up to and including 100 ft., preferably, 10 ft., 15 ft., 20 ft., 25 ft., 30 ft., among others. In addition, handle region 105A may also include any type of gripping surface, such as any type of rubber, fabric, textile, padding, foam material, silicone, or a combination thereof. In addition, pole member 105 (including members 105A and 105B) may be made of any suitable material, including but not limited to, carbon fiber, fiberglass, graphite-based materials, composite or other non-metals, steel materials, aluminum materials, other metal alloy materials, polymeric materials, combinations of various materials, and the like. In addition, or in the alternative, pole member 105 (including members 105A and 105B) may be coated with any type of material to improve its durability, such as via a process of powder coating with polymer resins, pigments, curing agents, and other additives, among others.

Figure 2:
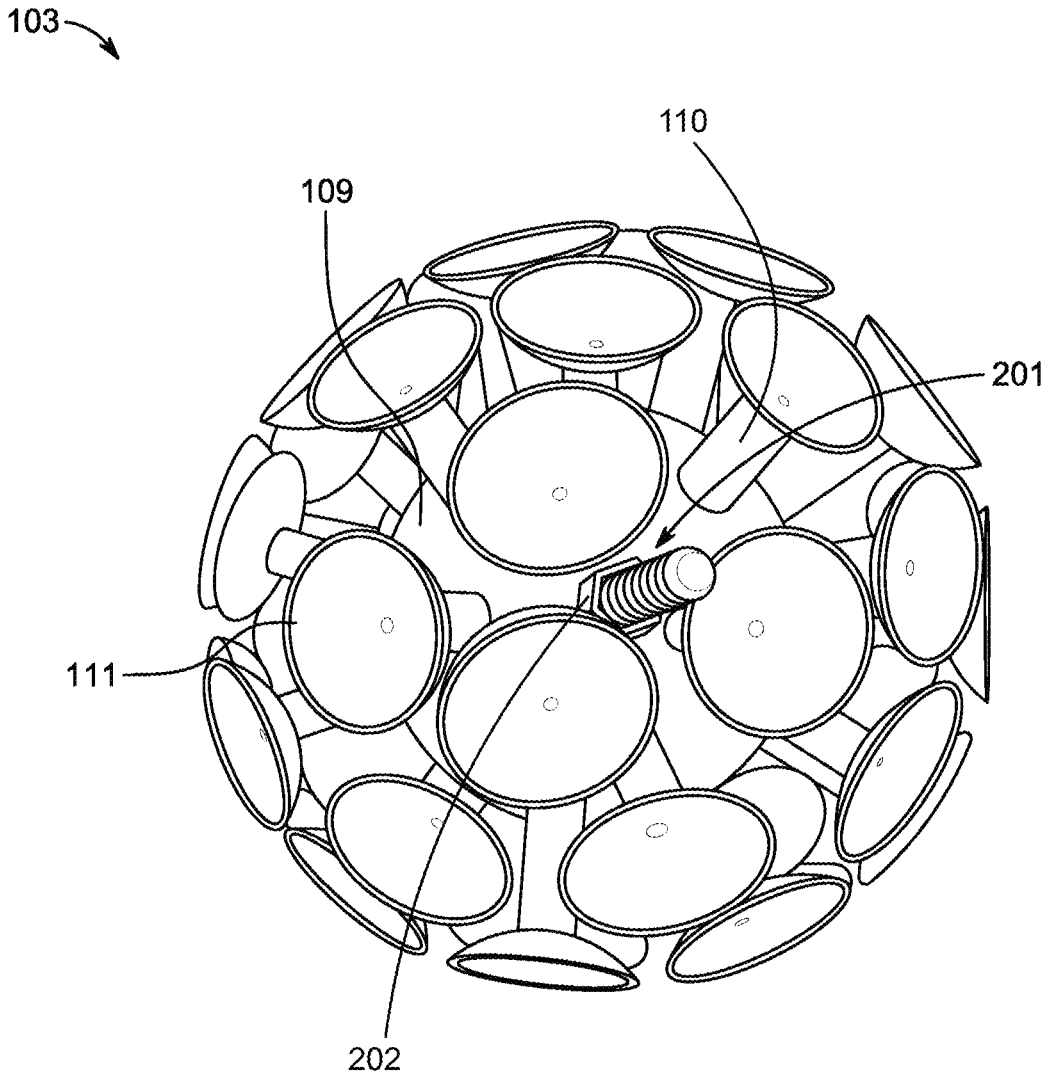
FIG. 2 illustrates a perspective bottom view of a retrieval head for the disc golf retrieval device of FIG. 1.

Referring to FIGS. 1-2, a distal end member 105C of pole member 105 may be secured to a securement member 107 that is adapted to secure to spherical member 109 of retrieval head 103. In some embodiments, securement member 107 may be a threaded female member adapted to receive a threaded male fastener member 201 extending from spherical member 109, such that pole member 105 may be removed and/or detached from retrieval head 103 and then re-attached or secured to head 103. In one embodiment, spherical member 109 may include a central bore, hole, or channel that allows an elongated threaded screw or bolt (such as member 201) to be slid or threaded therethrough, such that that a head of the screw abuts against the top region of member 109 and its tail end is exposed on the opposite bottom end of member 109, such as shown in FIG. 2. Here, the screw may be held in place and secured to member 109 via a nut/washer 202 threaded thereon. In another embodiment, securement member 107 or member 105C may be a threaded male member (or any extended/protruding member) that is secured directly to member 109 or via a threaded female member secured to member 109. However, it is contemplated within the scope of the present disclosure described herein that pole member 105 (including securement member 107) may be secured to the retrieval head 103 and/or spherical member 109 via any type of fastener, such as screws, bolts, magnets, rivets, pins, friction-based means, adhesives, or any combination thereof, among others.

Here, the ability for a user to remove retrieval head 103 allows the user to interchange various types of retrieval heads 103 with pole member 105, such as to replace, maintain, clean, or repair the retrieval head 103. In the alternative, the user may also be able to use an existing retrieval head 103 with any type of pole member 105, such as a pole member 105 that can telescope to 10 ft. or a pole member 105 that can telescope to 30 ft, or a pole member 105 made of another type of material, among other variations. In other embodiments, pole member 105 may also be non-removably fixed to retrieval head 103.

Figure 3:
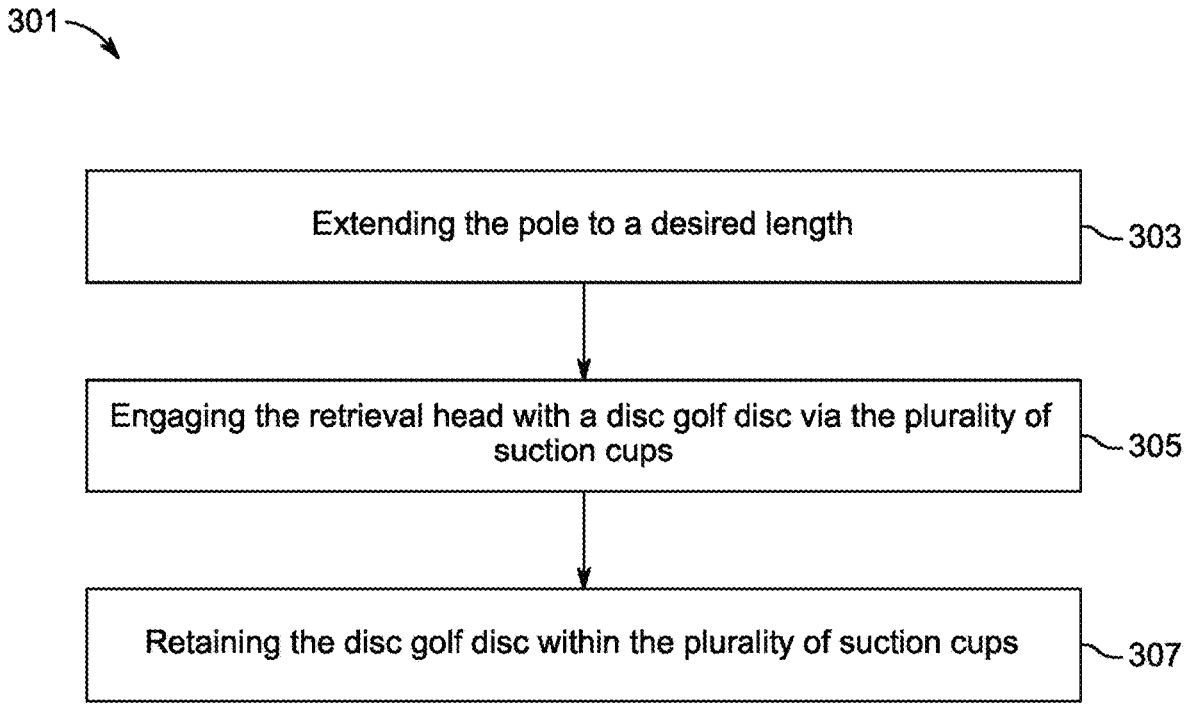
FIG. 3 is a flowchart diagram of a method of use of the disc golf disc retrieval device of FIG. 1, according to one non-limiting exemplary embodiment of the disclosure described herein.

FIG. 3 illustrates a flowchart 301 for one non-limiting exemplary embodiment of a method of use associated with the disc golf disc retrieval device 101 of the disclosure described herein. For example, at step 303, the telescoping pole member 105 can be extended by a user (such as via extending members 105B) to a desired length, depending on how far away or the distance of the area where the disc golf disc resides is relative to the position of the user holding the pole member 105 (such as in a tree, ditch, or a in a creek/river bank, among others). Next, at step 305, the retrieval head 103 is engaged with or made contact with a disc golf disc via the plurality of suction cups 111, such that the retrieval head is securely coupled to the 10) disc golf disc. Here, it is contemplated within the scope of the invention that a minimum of at least one suction cup can make contact with a conventional disc golf disc (such as made of plastic/polymers), wherein at least one suction cup has sufficient suction or vacuum force in order to retrieve and hold the weight of one disc golf disc. Next, at step 307, the user can then retain and bring the disc golf disc to himself or herself, such as pulling in (or pushing in) and retracting members 105B back into the handle region 105A of pole member 105 and detaching or disengaging the disc golf disc from one or more suctions cups 111 of the retrieval head 103.

Figure 4:
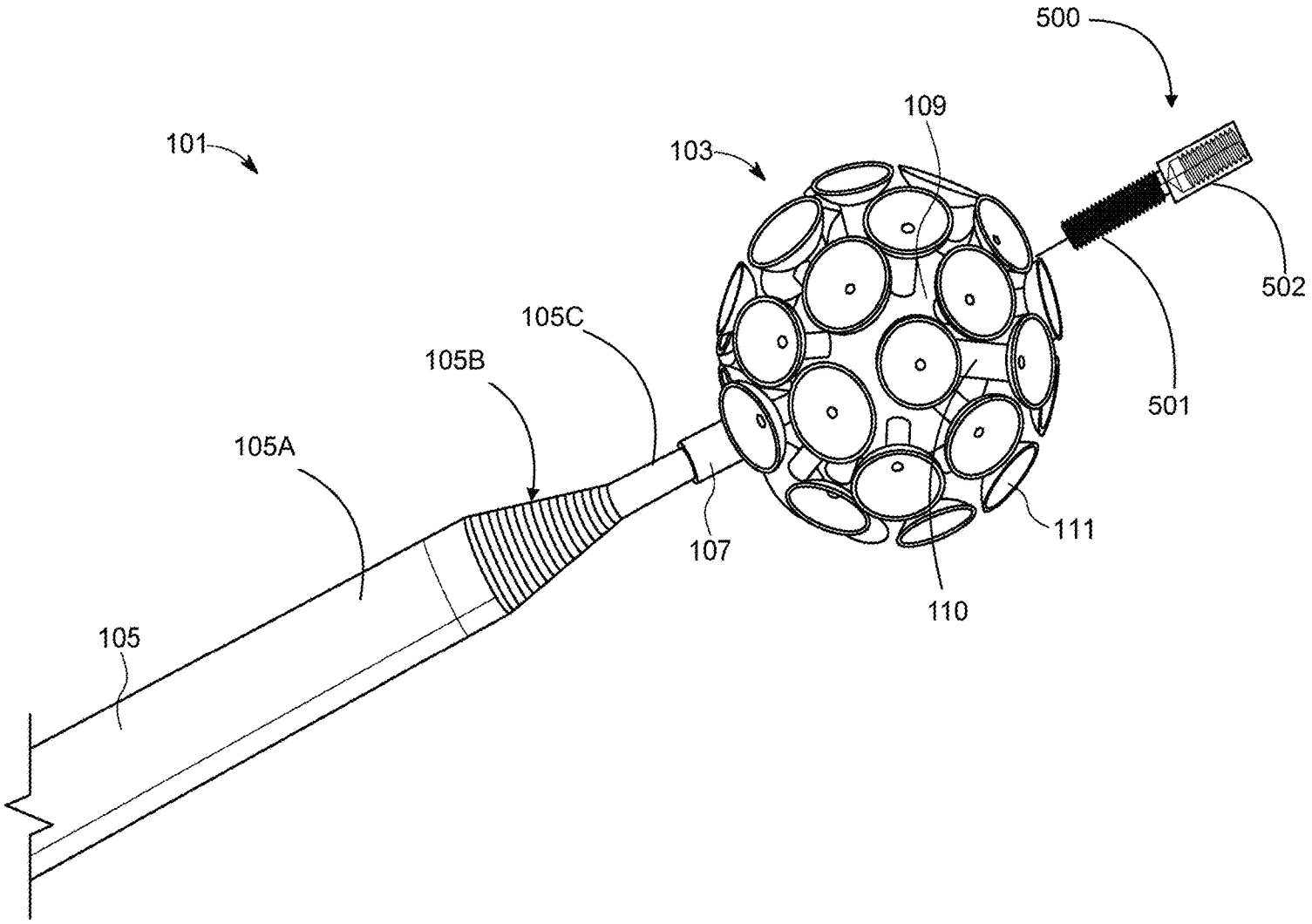
FIG. 4 illustrates a perspective view for the disc golf retrieval device, according to another non-limiting exemplary embodiment of the disclosure described herein.
Figure 5A:
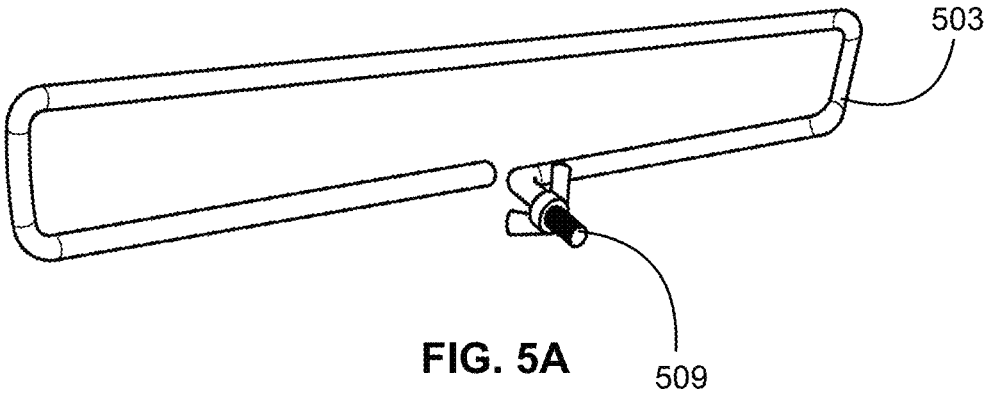
FIG. 5A illustrates a perspective view for an accessory for the disc golf retrieval device of FIG. 4, according to one or more non-limiting exemplary embodiments of the disclosure described herein.
Figure 5B:
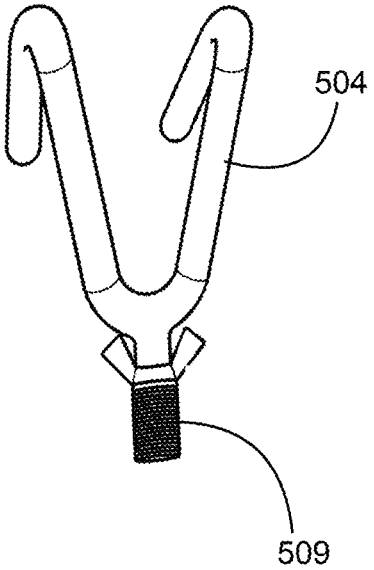
FIG. 5B illustrates a perspective view for another accessory for the disc golf retrieval device of FIG. 4, according to one or more non-limiting exemplary embodiments of the disclosure described herein.
Figure 5C:
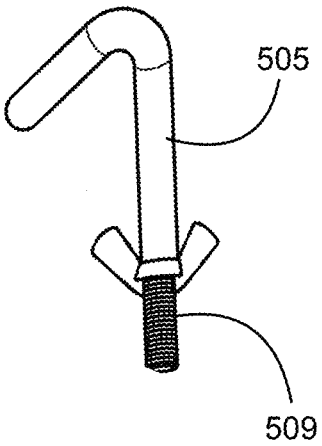
FIG. 5C illustrates a perspective view for another accessory for the disc golf retrieval device of FIG. 4, according to one or more non-limiting exemplary embodiments of the disclosure described herein.

FIG. 4 illustrates another non-limiting exemplary embodiment of the retrieval head 103 of the disclosure described herein being configured with one or more attachments, connectors, or securement members 500 configured to attach or secure to other devices or accessories to retrieval head 103. In one embodiment, securement member 500 may include a threaded male screw 501 that is adapted to be slid through or threaded through a central bore, opening, or channel within spherical member 109, that is further adapted to secure to female securement member 107 of pole member 105, thereby securing member 109 to pole member 105. In addition, on an opposing end of member 500, a female threaded receiving member 502 is included that allows for the attachment of other devices or accessories, including but not limited to accessories 503, 504, 505 as shown in FIGS. 5A-5C.

Referring to FIGS. 4 and 5A-5C, accessories 503, 504, and 505 include various types of hooks, claws, or receptacles, wherein each accessory 503-505 include a threaded male member 509 adapted to be removably secured to and received by receiving member 502. Here, accessories 503-505 can each further assist the user to orient, move, or grab a disc golf disc with device 101 (or using the accessories to move/brush debris away from the disc golf disc such that the suction cups can make proper contact) in order to assist with the engagement of the disc golf disc to the retrieval head 103 and/or suction cups 111. In some embodiment, the height of receiving member 502 can be configured such that it does not extend beyond the height of suction cups 111 in order to allow the suction cups to function when no other device or accessory is connected to receiving member 502.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in following claims. Further, it will be understood that certain features and sub-combinations are of utility and may be employed without reference to other features and sub-combinations. This is contemplated by and is within the scope of the claims.

What is claimed is:

1. A disc golf disc retrieval device, comprising:
a retrieval head;
a plurality of post members extending from the retrieval head, wherein each of the post members comprise a suction cup, and wherein the suction cup is configured to enable engagement of a disc golf disc thereto;
a telescoping pole member; and
a threaded securement member configured to secure the retrieval head to the telescoping pole member.

2. The disc golf retrieval device of claim 1, wherein the wherein the threaded securement member is comprised of a male threaded member.

3. The disc golf retrieval device of claim 2, wherein the telescoping pole member comprises a female threaded member adapted to be secured to the male threaded member.

4. A disc golf disc retrieval system, comprising:
a retrieval head;
a plurality of post members extending from the retrieval head;
a suction cup secured to each of the plurality of post members;
a telescoping pole member;
a securement member configured to secure the retrieval head to the telescoping pole member; and
a disc golf disc retrieval accessory secured to the securement member, wherein the disc golf disc retrieval accessory is comprised of a hook member.

5. A disc golf disc retrieval device, comprising:
a spherical member;
a plurality of suction cups extending from the spherical member, the plurality of suction cups configured to enable engagement of a disc golf disc thereto;
a threaded first member extending from the spherical member;
a second member at least partially disposed around the first member and engaged therewith; and
a telescoping pole member, wherein the spherical member is secured to the telescoping pole member via the threaded first member.

6. The disc golf disc retrieval device of claim 5, wherein the threaded first member is comprised of a screw and the second member is comprised of a nut.

7. A disc golf disc retrieval device, comprising:
a spherical member;
a plurality of suction cups extending from the spherical member, the plurality of suction cups configured to enable engagement of a disc golf disc thereto;

an elongated threaded first member extending from the spherical member and disposed between at least three of the plurality of suction cups;

a second member adjacent to the spherical member and at least partially disposed around the first member; and wherein the elongated threaded first member is configured to enable a threaded engagement with a telescoping pole member.

8. The disc golf disc retrieval device of claim 7, wherein the elongated threaded first member is comprised of a screw and the second member is comprised of a nut.

* * * * *